United States Patent [19]

Wood

[11] Patent Number: 4,794,213

[45] Date of Patent: Dec. 27, 1988

[54] DELAYED ACTION SWITCH ACTUATOR

[76] Inventor: D. Gregory Wood, 40 Baytree Way, San Mateo, Calif. 94402

[21] Appl. No.: 173,218

[22] Filed: Mar. 25, 1988

[51] Int. Cl.[4] ..... H01H 3/70; H01H 43/00

[52] U.S. Cl. ..... 200/33 R; 200/330

[58] Field of Search ..... 200/33 R, 34, 61.45 R, 200/61.93, 330–332, 329, 325, 338, DIG. 11

[56] References Cited

U.S. PATENT DOCUMENTS

| | | | |
|---|---|---|---|
| 2,248,846 | 7/1941 | Brewes | 200/33 R |
| 2,252,829 | 8/1941 | Bell | 200/330 |
| 2,524,215 | 10/1950 | Wegehaft | 200/330 |
| 2,550,889 | 5/1951 | Tyler | 200/33 R X |
| 2,637,788 | 5/1953 | Bracken | 200/34 |
| 3,179,396 | 4/1965 | Bracken | 200/330 X |
| 3,484,090 | 12/1969 | Mahoney | 200/330 X |
| 3,499,132 | 3/1970 | Stevens | 200/61.93 |
| 4,206,452 | 6/1980 | Blasucci | 200/61.93 X |

*Primary Examiner*—J. R. Scott

*Attorney, Agent, or Firm*—Townsend and Townsend

[57] ABSTRACT

A delayed action switch actuator includes a spring attached to one corner of a face plate, a suction cup and a ring-like toggle engaging member, sized to surround the toggle passing through the face plate, connecting the spring to the suction cup. The spring is sized to be in tension when the toggle-engaging member is in a toggle-engaging position. The suction cup is affixable to a roughened surface area on the face plate. The suction cup forms an imperfect seal with the roughened surface area, which results in the suction cup releasing after a period of time, such as a minute or two. The toggle is located between the point of attachment of the spring on one side of the face plate and the roughened area on the other side of the face plate. When the suction cup releases, the spring, which is in tension, pulls on the toggle-engaging member which subsequently trips the toggle.

8 Claims, 1 Drawing Sheet

DELAYED ACTION SWITCH ACTUATOR

BACKGROUND OF THE INVENTION

There are many instances in our day to day activities where one needs to have a light switch tripped after one has left the immediate proximity of the switch. The delayed action switch actuator is a device which provides an answer to this need. A device of this type can be electrical or mechanical.

Electrical delayed action switch actuators, that is, devices which will electronically turn off the power after a time period, are generally more exact as to the reproducibility and the length of the time period than their mechanical counterparts. However, there are a number of difficulties inherent to this type of electrical device which are encountered by the manufacturer and consumer. First, an electrical device which is being added on to the existing electrical system of a house, no matter how simple, must comply with the operational parameters of the electrical system to which it is being added. This places restrictions on the type of components that can be used, both from a performance and a safety standpoint. Secondly, the installation of an electrical device requires tapping into the electrical system of the house, which entails turning the power off before commencing work and taking particular care to insure that all connections are made correctly to avoid shorts and other potential problems. It is not necessarily a trivial process. And finally, an electrical device that is being connected to a building's electrical system is generally subject to various levels of scrutiny and regulations by governmental organizations regarding its safety and performance so as to protect the consumer. This increases the overhead cost of each product, which ultimately results in a more expensive product to the consumer.

A mechanical delayed switch actuator avoids many of problems encountered by its electrical counterpart because it operates without direct intervention to the electrical system of the building. There are various patented devices which employ different mechanical means to throw a switch. The Bracken patent, U.S. Pat. No. 2,637,788, shows a spring-actuated time delay toggle switch actuator. It uses a pneumatic cylinder and a spring biased piston which extends to actuate the toggle. The Stevens patent, U.S. Pat. No. 3,499,132, shows a spring loaded striker pivotally mounted to the switch plate. The striker is released by suitable means, such as a falling weight actuated by some external event, such as the opening of a door.

The problem encountered in these devices is that they are relatively complicated in their design and operation for the simple task they perform. Aside from the absurdity of what would seem to be an overkill solution to a simple problem, the added complexity results in greater costs in material and production, which ultimately translates to a larger price tag for the consumer. Also, by making the device overly complicated, there are created a greater number of places and possibilities for malfunction, which will influence the overall utility of the device to the consumer.

Ideally, one would hope for an invention which would automatically trip a light switch with minimal hardware, minimal effort in installation and at minimal cost, while at the same time offer reliability and safety to the user. The present invention does just that.

SUMMARY OF THE INVENTION

The present invention provides an inexpensive and simple device for the delayed actuation of a switch. Briefly, the invention acts upon a switch having a toggle movable between first and second orientations. The invention is typically mounted onto an existing face plate, but can be produced as part of the face plate assembly. A spring is attached to the face plate at a first position. A toggle-engaging member, whose purpose is to contact and ultimately trip the toggle, is attached to the spring thereby forming a spring assembly. A suction cup is attached to the spring assembly, typically to the toggle-engaging member. An imperfect seal is created between the suction cup and the face plate. Preferably the imperfect seal is created by a roughened surface area situated at a second position on the face plate. The spring is sized such that it is flexed, preferably in tension, when the toggle-engaging member is in position to engage the toggle. After a period of time, such as a minute or two, the imperfect seal will cause the suction cup to release, which will result in the spring forcing the toggle-engaging member toward the position where the spring is attached thereby tripping the toggle.

A principal advantage of this invention is its simplicity of design. The invention performs a simple (although potentially complicated) task in a straightforward and direct manner. The invention trips a light switch after a period of time without the need for any electrical connections or devices. The invention is mechanical in nature and is mounted on the external surface of the face plate. By virtue of the invention's mode of operation, that is, mechanical versus electrical, it obviates complications both technical and bureaucratic that can be encountered.

Another advantage of this invention is that it accomplishes a basic task, which is normally performed with costly devices, with inexpensive, easily procured components.

A further advantage of this invention is its ease of installation. Since the invention doesn't involve any electrical connections, it eliminates the need to do anything other than removing the face plate. The invention can be manufactured as a premounted unit on a face plate or as an add on option. As a premounted unit, the invention is implemented by replacement of the old face plate with the new one. As an add on option, the invention can be secured in place by use of an adhesive or by a mechanical device, like a screw. Mounting by use of an adhesive does not require the removal of the face plate. Where the invention is secured in place with a screw, the face plate is commonly removed and a hole is made where the spring attachment is to be located. The attachment is secured by passing the screw through the hole and into the attachment. Preferably the screw and the spring attachment is composed of a nonconducting material, which would insulate the unit from electrical shock. Thus the novice home electrician is not exposed to hazards that lurk within electrical switch boxes. Not only is this an obvious safety feature, it also makes the device very attractive to the user who is potentially intimidated by technical devices. The advantages of this invention are thereby made available to potential users who would otherwise have to forego use because of the added bother of installation.

DETAILED DESCRIPTION OF THE PREFERRED EMBODIMENTS

Figure 1:
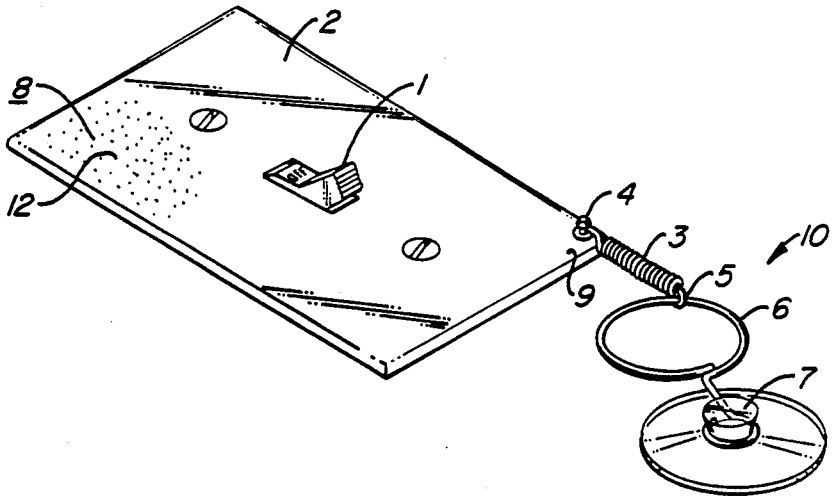
FIG. 1 is a front, bottom and side perspective view of the invention mounted to a face plate not set to trip the light switch.

The invention is designed for use with a switch having a toggle 1 movable between first and second orientations and a face plate 2 having an opening through which the toggle passes. Referring to drawing FIG. 1, a delayed action switch actuator is shown to include a spring 3, a toggle-engaging member 6 and a suction cup 7 connected in series as described below.

Spring 3 is attached at one end 4 to a first position 9 on the lower half of the face plate and attached at the other end 5 to toggle-engaging member 6. Spring 3 is sized such that it is in tension when toggle-engaging member 6 is engaged with, that is surrounding, toggle 1.

Toggle-engaging member 6 in the preferred embodiment is a ring, but it can be any variety of shapes so long as it can engage the toggle when the suction cup 7 releases, as is discussed below. Spring 3 and toggle-engaging member 6 form a spring assembly 10.

Suction cup 7 adheres to a second position 12 at a roughened surface area 8 on the upper half of face plate 2. Roughened surface area 8 constitutes an imperfect suction element. Toggle 1 is located directly between positions 9 and 12. The seal which is formed by suction cup 7 when it is affixed to face plate 2 is imperfect because of the roughness of the surface. When suction cup 7 is temporarily affixed to position 12, toggle-engaging member 6 partially surrounds toggle 1 and spring 3 is stretched so as to be in tension. When suction cup 7 releases, the force of spring 3 returning to its resting state causes toggle-engaging member 6 to snap upward tripping toggle 1 to its off position, in the preferred embodiment.

The invention can be embodied in a number of forms. A torsional spring or another similar apparatus can be used to supply the force to the spring assembly.

The period of time before suction cup 7 releases can be modified by altering the location of second position 12 in relation to first position 9. The further they are apart, the greater the tension on spring assembly 10, and hence, the sooner the seal is broken.

Another way of modifying the time period is by changing the spring 3. For example, the stronger the spring (for a given position of suction cup 7) the quicker the release.

Figure 2A:
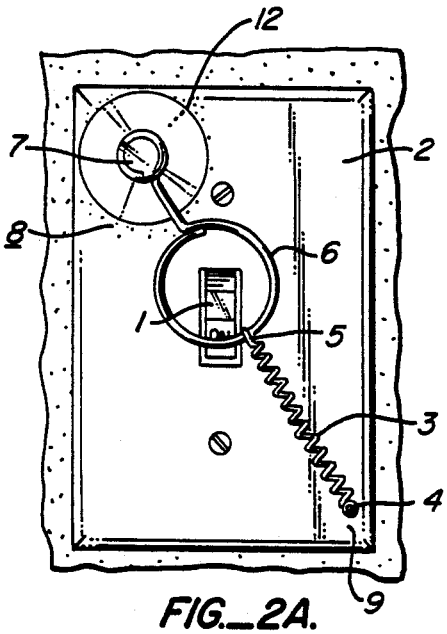
FIG. 2A is a front view of the invention with the suction cup attached maintaining the spring in tension, set to trip the light switch.
Figure 3:
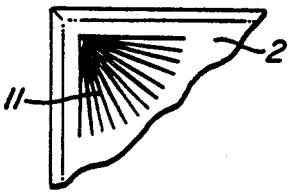
FIG. 3 is a front view of an alternate embodiment where the roughened surface area is created by a fan-shaped series of very shallow grooves.
Figure 2B:
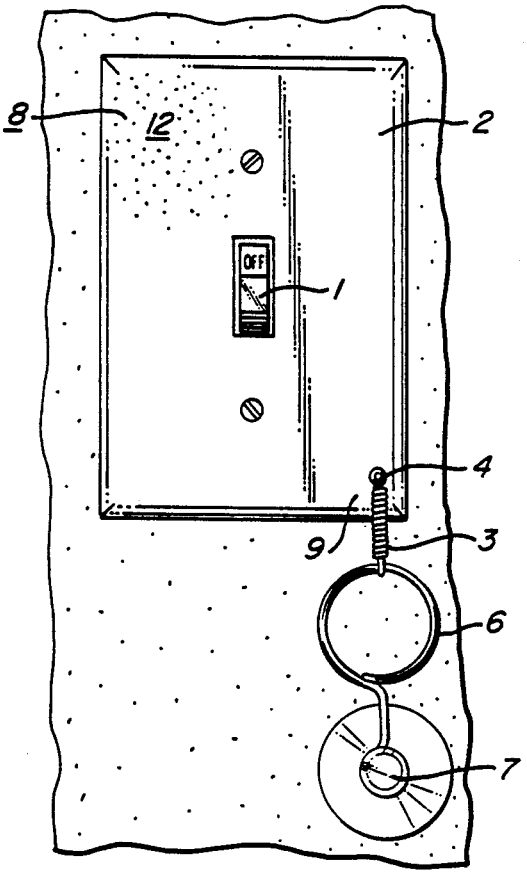
FIG. 2B is a front view of the invention after the suction cup has released tripping the switch.

Another way to vary the time to release would be to have the roughened area include a series of grooves 11 on the face plate as shown in FIG. 2C. Grooves 11 are dimensioned and positioned such that the number of grooves 11 beneath suction cup 7 varies according to the location of suction cup 7. By creating a gradation in the number of grooves 11 leaking air beneath suction seal 7, the time period during which the suction cup will hold can be controlled. That is, affixing suction cup 7 to a location with a lesser number of grooves will result in a longer time to release because of the slower leak. Conversely, a shorter time to release will result when the suction cup is affixed to an area with a greater number of grooves.

Modification and variation can be made to the preferred embodiment without departing from the subject of the invention as defined by the following claims. For example, instead of a roughened surface. the imperfect suction element could be provided by forming an adjustable bleed hole (not shown) in suction cup 7. The slow entry of air through the bleed hole would gradually degrade the seal. The ability to adjust the rate at which the air is bled under the suction cup would allow the time period to be altered to that desired. The first and second positions as previously described, may be interchanged.

I claim:

1. A delayed action switch actuator, for use with a switch having a toggle movable between first and second orientations and a face plate having an opening through which the toggle passes, comprising:
   - a spring attached to the face plate at a first position;
   - a toggle-engaging member attached to the sspring to create a spring assembly, the spring assembly sized to be flexed when the toggle-engaging member is in a toggle-engaging position; and
   - suction cup means for temporarily maintaining the spring assembly in tension, the suction cup means including:
     - a suction cup attached to the spring assembly and affixable to a second position on the face plate; and
     - means for creating an imperfect seal between the suction cup and the face plate such that the suction cup releases after a period of time whereupon the spring forces the toggle-engaging member towards the toggle to trip the toggle from its first orientation to its second orientation.

2. A delayed action switch actuator as in claim 1 wherein the suction cup means is attached directly to the toggle-engaging member.

3. A delayed action switch actuator as in claim 1 wherein the toggle is located between the first and second positions.

4. A delayed action switch actuator as in claim 1 wherein the toggle-engaging member includes a ring.

5. A delayed action switch actuator as in claim 1 wherein the first position is situated at a lower half of the face plate and the second position is situated at an upper half of the face plate.

6. A delayed action switch actuator as in claim 1 wherein the imperfect seal means includes a roughened surface at the second position on the face plate which creates the imperfect seal.

7. A delayed action switch actuator as in claim 1 wherein the first position is situated in a corner of the upper half of the face plate and the second position is situated in an oblique corner of the lower half of the face plate.

8. A delayed action switch actuator, for use with a switch having a toggle movable between first and second orientations and a face plate having an opening through which the toggle passes comprising:
   - a spring having first and second ends, the first end attached to a first position on the face plate;
   - a toggle-engaging member attached to the second end of the spring to create a spring assembly, the spring assembly sized to be in tension and parallel to the face plate when the toggle-engaging member engages the toggle; and suction cup means for temporarily maintaining the spring assembly in tension, the suction cup means including a suction cup attached to the spring assembly and affixable to a second position on the face plate, the first position and the second position and the toggle being in a generally straight line, the suction cup means also including a roughened surface on the face plate at the second position to create an imperfect seal between the suction cup and the face plate such that the suction cup releases after a period of time whereupon the spring pulls the toggle-engaging member towards the first position to trip the toggle from its first orientation to its second orientation.

* * * * *